United States Patent [19]

Starnes et al.

[11] Patent Number: 4,601,225

[45] Date of Patent: Jul. 22, 1986

[54] APPARATUS FOR AUTOMATICALLY CUTTING APART SUCCESSIVE ARTICLES

[75] Inventors: Dennis L. Starnes; William G. Kimball, both of Kannapolis; Robert E. Watson, Concord, all of N.C.

[73] Assignee: Cannon Mills Company, Kannapolis, N.C.

[21] Appl. No.: 707,745

[22] Filed: Mar. 4, 1985

[51] Int. Cl.[4] ..... B26D 7/02; B26D 7/14

[52] U.S. Cl. ..... 83/175; 83/208; 83/282; 83/371

[58] Field of Search ..... 83/18, 175, 371, 208, 83/209, 282

[56] References Cited

U.S. PATENT DOCUMENTS

| | | | |
|---|---|---|---|
| 2,966,086 | 12/1960 | Sjostrom . | |
| 2,987,809 | 6/1961 | Burbank | 83/175 X |
| 3,007,359 | 11/1961 | Lang et al. | 83/175 |
| 3,182,536 | 5/1965 | Sumpter, Jr. et al. | 83/175 X |
| 3,192,811 | 7/1965 | Simmons | 83/175 |
| 3,246,816 | 4/1966 | Dexter et al. | 226/4 |
| 4,034,634 | 7/1977 | Arbter | 83/18 |
| 4,375,175 | 3/1983 | Elsas et al. | 83/175 X |
| 4,397,203 | 8/1983 | Brack et al. | 83/175 X |
| 4,437,369 | 3/1984 | Brocklehurst et al. | 83/18 |

*Primary Examiner*—James M. Meister

*Attorney, Agent, or Firm*—Bell, Seltzer, Park & Gibson

[57] ABSTRACT

An apparatus is provided for automatically cutting apart successive articles, such as terry towels, from a continuous length of material, in which such articles are separated therein by portions extending transversely across the material and of less thickness than the articles, so that each cut article has an equal amount of thinner portion remaining on each cut edge for subsequent hemming or the like. The apparatus includes devices for automatically aligning and positioning the thinner separating portion of the material relative to a cutting device so that the cutting device will cut the articles apart generally through the center of the thinner separating portion of the material.

13 Claims, 11 Drawing Figures

APPARATUS FOR AUTOMATICALLY CUTTING APART SUCCESSIVE ARTICLES

FIELD OF THE INVENTION

This invention relates to apparatus for automatically cutting apart successive articles, such as terry towels, from a continuous length of material, in which such articles are separated therein by portions extending transversely across the material and of less thickness than the articles, so that each cut article has an equal amount of thinner portion remaining on each cut edge for subsequent hemming or the like.

BACKGROUND OF THE INVENTION

In a number of textile manufacturing operations, continuous textile material is produced having thickened individual portions woven therein in series longitudinally of the material and which are separated by thinned portions extending transversely across the material. This is particularly true in textile manufacturing operations for producing terry towels in which the thickened portions are individual terry towels and the thinner portions are nonterry.

In the fabrication of individual articles, such as terry towels, from such woven textile material, the individual articles must be cut apart along the transversely-extending thinner portions and an equal amount of such thinner portion should remain on each cut edge of the cut-apart article for subsequent hemming or the like finishing operation along such cut edge.

Heretofore, these fabricating operations have been performed, for the most part, manually by an operator utilizing a cutting mechanism, since the cutting mechanism had to be visually guided along generally the center of the thinner separating portions of the material or the material had to be aligned relative to a stationary cutting mechanism to provide generally equal amounts of the thinner portion on each cut edge after the cutting operation for the subsequent hemming or other finishing operation. These manual operations were not entirely satisfactory inasmuch as they often resulted in unequal and consistent amounts of the thinner portion remaining on each cut edge. Also, these manual operations were time consuming, labor absorbing and expensive.

While some automatic and semi-automatic machines have been proposed which attempted to align and position the thinner separating portion of the material relative to a cutting device so that the cutting device would cut the articles apart generally through the center of the thinner separating portion of the material, these semi-automatic or automatic machines have not been commercially successful for many reasons including the inability to properly align and position such thinner separating portions of the material relative to the cutting device.

OBJECT AND SUMMARY OF THE INVENTION

Accordingly, it is the object of this invention to provide an apparatus for cutting apart successive articles, such as terry towels, from a continuous length of material, in which such articles are separated therein by portions extending transversely across the material and of less thickness than the articles, and which overcomes the problems discussed above and provides an automatic apparatus which will insure that each cut article has an equal amount of the thinner portion remaining on each cut edge for subsequent hemming or other finishing operation.

By this invention, it has been found that the above object may be accomplished by an apparatus generally as follows:

An overall frame for the apparatus is provided for mounting the various devices thereon. A cutting means transversely cuts the material to separate the successive articles. Means sequentially feed the continuous material through the apparatus in generally a longitudinally-extending path of travel and stop the material in a cutting position in which the next successive thinner separating portion of the material is generally adjacent the cutting means. Means align and position the thinner separating portion of the material relative to the cutting means so that the cutting means will cut the articles apart generally through the center of the thinner separating portion of the material.

This aligning and positioning means includes a pair of movable blade means positioned transversely across and perpendicularly to the one surface of the material in the apparatus and in equally spaced relation on each side of the cutting means. Means are provided for moving the pair of blade means between a first position out of engagement with the material when the material is being fed by the feeding means and a second position in engagement with the thinner separating portion of the material which has been positioned adjacent the cutting means. Means are also included for moving each of the blade means after engagement with the material between an inward position in which said blade means are spaced apart a distance less than the longitudinal dimension of the thinner separating portion in the material and an outward position in which said blade means are spaced apart a distance substantially equal to the longitudinal dimension of the thinner separating portion. With this arrangement, the blade means will be moved apart into engagement with the respective edges of the thicker articles joining the thinner separating portion transversely across the material for aligning and positioning the thinner separating portion equally on each side of the cutting means.

BRIEF DESCRIPTION OF THE DRAWINGS

Some of the objects and advantages of this invention having been stated, other objects and advantages will appear as the description of a preferred embodiment of this invention is given in conjunction with the accompanying drawings, in which.

DETAILED DESCRIPTION OF A PREFERRED EMBODIMENT OF THIS INVENTION

Figure 1:
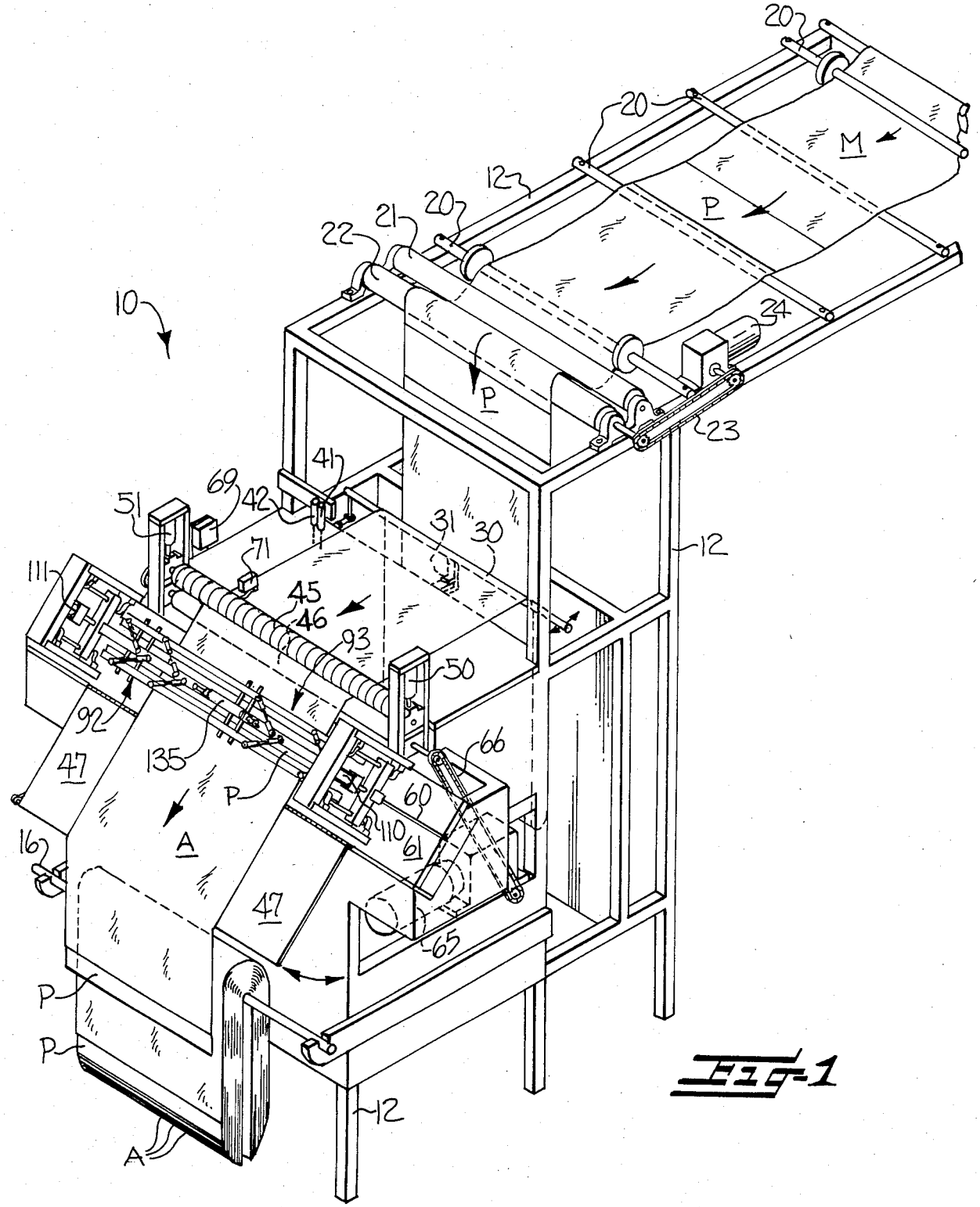
FIG. 1 is a perspective view of a preferred embodiment of the apparatus of this invention.
Figure 2:
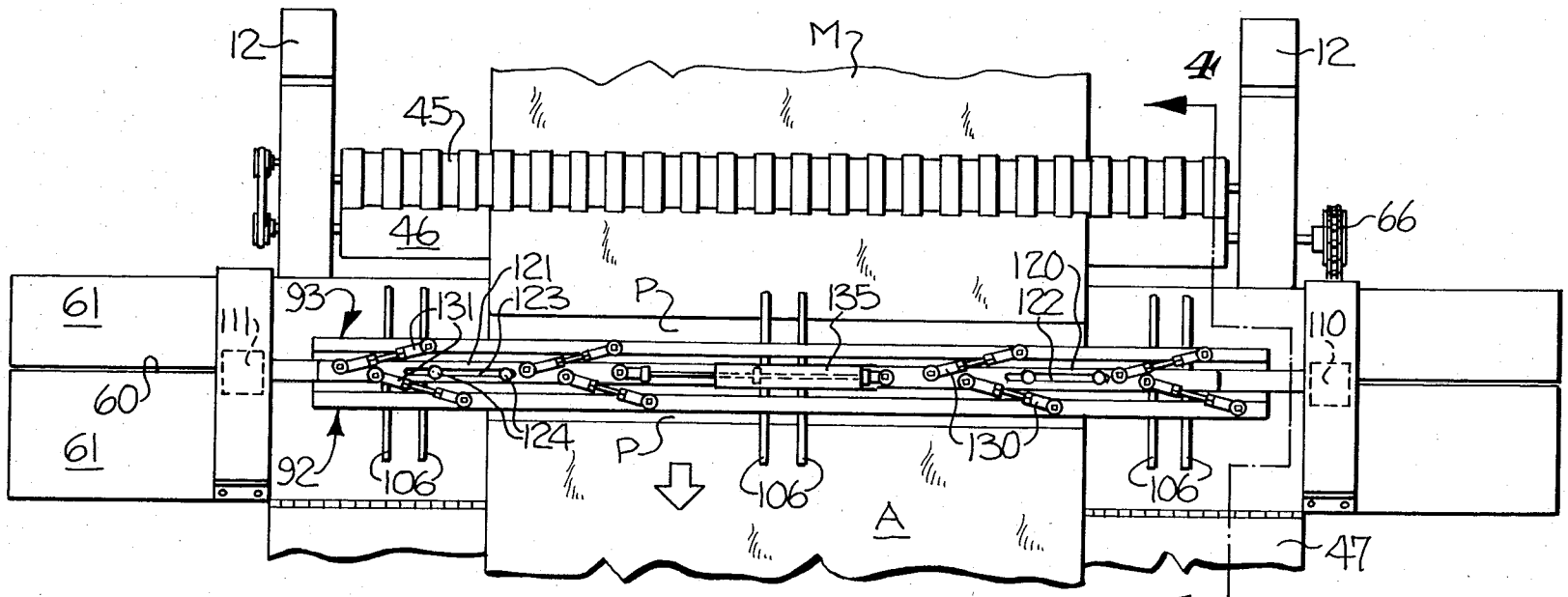
FIG. 2 is an enlarged, top plan view of the aligning and positioning mechanism utilized in the apparatus of FIG. 1, with such aligning and positioning apparatus in its initial position before the aligning and positioning operation.
Figure 3:
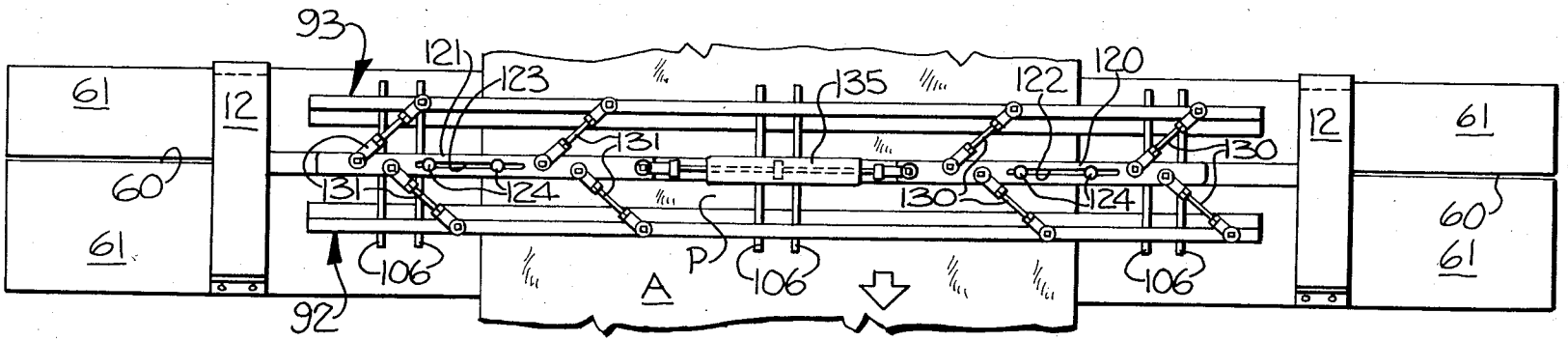
FIG. 3 is a top plan view of a portion of the mechanisms illustrated in FIG. 2 and showing the positioning and aligning mechanism in its second position after the aligning and positioning operation.
Figure 10:
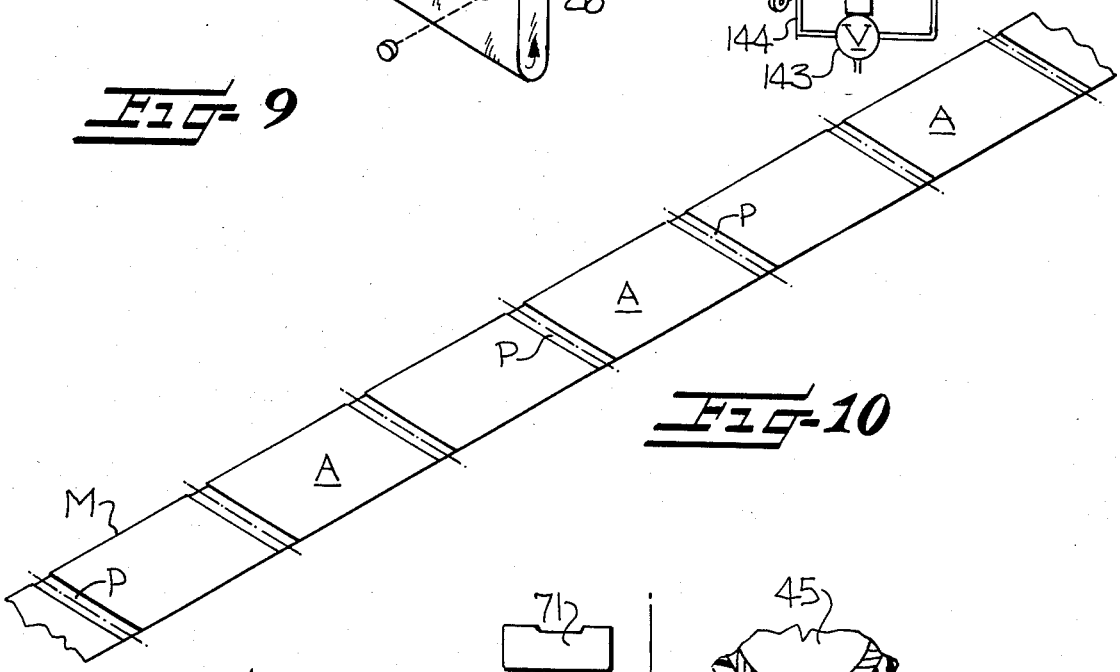
FIG. 10 is a top plan view of the continuous material having successive articles therein separated by portions of less thickness than the articles and which is being automatically cut apart by the apparatus of this invention.
Figure 11:
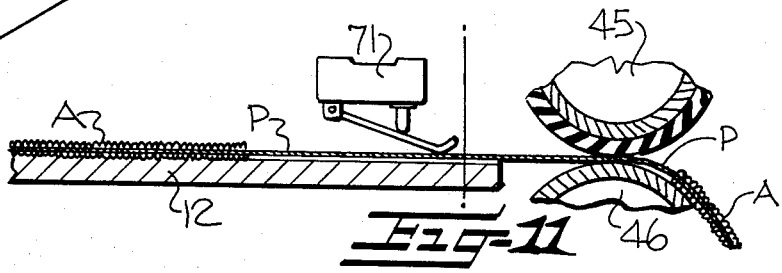
FIG. 11 is a sectional detail showing particularly the operation of a switch utilized as part of the control means for the material feeding means of the apparatus of FIG. 1.

Referring now to the drawings, there is illustrated therein a preferred embodiment of apparatus constructed in accordance with this invention, generally indicated at 10, for automatically cutting apart successive articles A from a continuous length of material M, in which such articles A are separated therein by portions P extending transversely across the material M and of less thickness than the articles A, so that each cut article A has an equal amount of the thinner portion P remaining on each cut edge for subsequent hemming or other finishing operation (see particularly FIGS. 1, 10 and 11). As illustrated in the drawings and as described herein, the articles A are woven terry towels and the thinner separating portions P are nonterry portions. However, it is to be understood that the invention is applicable to other products or articles.

The apparatus 10 of this invention is substantially illustrated in its entirety in FIG. 1 and details of various portions of the apparatus 10 are illustrated in the remaining Figures of the drawings. Some of these remaining Figures of the drawings are somewhat schematic or diagrammatic for simplicity and clarity of illustration and they do not necessarily illustrate all of the mechanisms and devices contained in the overall apparatus 10. However, the Figures of the drawings do illustrate all of the features considered to be important in the apparatus of this invention and the remaining unillustrated diagrammatically illustrated devices are conventional, commercially-available and well-understood by those with ordinary skill in the art.

The apparatus 10 includes firstly a frame means, collectively indicated by the reference numeral 12, for carrying the various mechanisms and devices contained in the apparatus 10, to be described below. The collective frame components constituting the frame means 12 may be interconnected and/or separated at various portions along the apparatus 10, as desired.

The apparatus 10 further includes feeding means, to be described in more detail below, for feeding the continuous textile material M from a supply (not shown) through the apparatus 10 in a generally longitudinally-extending path of travel to a take-up or stacking device 16 (shown generally in FIG. 1).

The material is first fed from the supply over a plurality of guide rods 20 carried by the frame 13 for receiving and guiding the material M as it passes from the supply forwardly through the apparatus 10. There is further included a pair of feeding rolls 21, 22 in which the roll 22 is driven by a chain and sprocket or belt and pulley drive 23 from an electric motor 24. These feed rolls 21, 22 feed the material M from the supply into a downwardly extending loop (see FIGS. 1 and 9) which serve as a reserve supply of the material M for subsequent operations in the apparatus 10. As the downwardly extending loop of material reaches a lower predetermined position, it is sensed by a photoelectric sensor 26 (see FIG. 9) which in turn is connected to the electric motor 24 through a circuit 27 including a timer 28, so that the photoelectric cell sensor 26 will stop operation of the electric motor 24 following a predetermined period of time determined by the timer 28 to allow for longer articles A to be available for cutting apart as the material is subsequently fed through the apparatus 10.

The material M then passes over means for aligning the traveling material M in a desired longitudinal path of travel. This aligning means includes an aligning rod 30 (see FIGS. 1 and 9) pivotally mounted at 31 on the frame 12 for receiving the traveling material and for being moved about its pivot generally in the longitudinal direction of the traveling material M to cause the traveling material M to move transversely into the desired longitudinal alignment. Means are connected to the rod 30 for such back and forth pivotal movement in the form of a fluid-operated double-acting piston and cylinder mechanism 32 which is carried by the frame 12 and may be connected at one end of the rod 30 (see FIG. 9). There may also be provided a hydraulically-separated piston and cylinder mechanisms 33, 34 for dampening and slowing down the back and forth movement of the rod 30 by the pneumatic piston and cylinder mechanism 32. For controlling the fluid-operated piston and cylinder mechanism 32, there is provided a solenoid valve 36 for controlling the flow of fluid from a supply line 37 through respective lines 38, 39 to opposite sides of the piston and cylinder mechanism 32. This solenoid-operated valve 36 is in turn controlled by an electric circuit 40 from a pair of photoelectric cell sensing devices 41, 42 which sense one of the longitudinal edges of the material M and control movement of the rod 30 in response to the position of the sensed edge.

From the aligning rod 30, the material M is fed forwardly between further feeding means in the form of a pair of driven feed rolls 45, 46 which are carried by the frame 12 and then along a stationary guide plate 61 carried by the frame 12 and a movable guide plate 47 pivotally mounted on the frame 12. Both guide plates 61, 47 are positioned at a downwardly extending angle to the horizontal for receiving the material M from the feed rolls 45, 46 and allowing the material M to feed forwardly at the downwardly-extending angle by gravity into a cutting position to be described more fully below.

Figure 9:
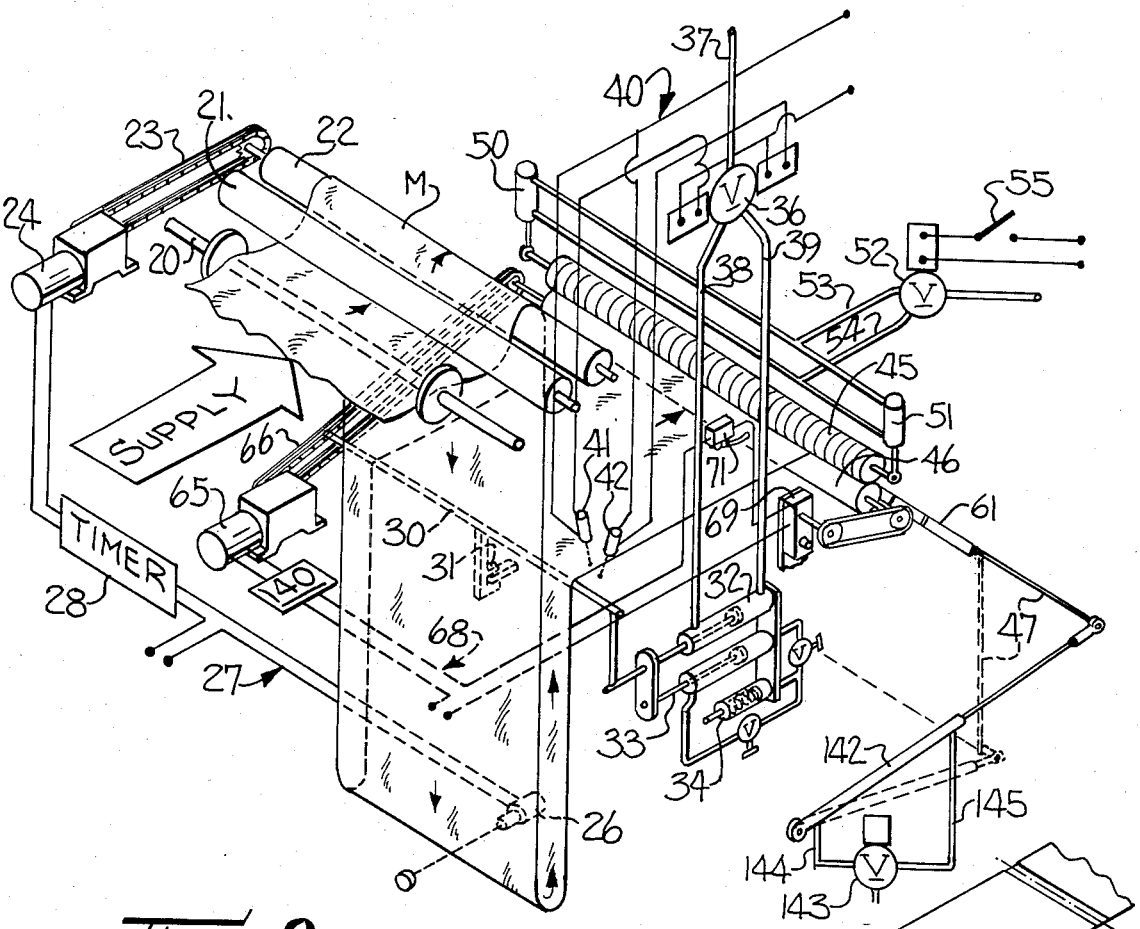
FIG. 9 is a schematic and diagrammatic view showing operation of the material feeding mechanism and certain other aligning and handling mechanisms utilized in the apparatus of FIG. 1.

The upper feed roll 45 is adapted for up and down movement by being connected to fluid-operated piston and cylinder devices 50, 51 which are controlled by a solenoid operated valve 52 in fluid supply lines 53, 54 to the piston and cylinder mechanisms 50, 51. The solenoid-operated valve 52 is in turn controlled by a switch 55 in an electric circuit 56. With these mechanisms, the switch 55 can be actuated (as shown in FIG. 9) to allow the flow of fluid to the piston and cylinder mechanisms 50, 51 to lower the feed roll 45 into engagement with the feed roll 46 for feeding of the material M between such feed rolls 45, 46. Likewise, the switch 55 controls the flow of fluid to the piston and cylinder mechanisms 50, 51 to raise the feed roll 45 out of engagement with the feed roll 46 for initial threading-up operation of the material M through feed rolls 45, 46.

The feed roll 46 is a selectively driven feed roll and is operated by a control means operatively connected to the feed roll 46 for driving the feed roll to feed the continuous material M and for stopping the continuous material M in the cutting position. The cutting position of the material M is generally indicated in FIG. 1 in which the next uncut thinner separating portion P is positioned over a cutting slot 60 in a downwardly extending stationary guide plate 61. The cutting operation at the cutting slot 60 will be explained in more detail below.

The control means for the feed roll 46 includes a selectively-operable electric motor 65 (see FIG. 9) carried by the frame 12 and connected to the feed roll 46 by a chain and sprocket or belt and pulley drive 66. Electric circuit means 68 are connected to the motor 65 for selectively operating the motor 65. An adjustable pulse counter device 69 is connected in the circuit 68 for actuating the circuit 68 to start the motor 65 for feeding the material M and for deactuating the circuit 68 to stop the motor 65 and the feed of the material M. A material sensing switch 71 (see FIGS. 1, 9 and 11) is connected in the circuit 68 and is carried by the frame 12 a predetermined distance from the cutting slot 60 in the path of travel of the material M for engaging the upper surface of the continuous material M to sense the thinner portions P in the material M. The material M is initially fed a first predetermined distance upon actuation of the circuit 68 by the pulse counter 69 and then the switch 71 is activated to signal the pulse counter 69 after sensing a thinner portion P for maintaining the circuit 68 actuated for feeding the material M a second predetermined distance equal to the distance between the switch 71 and the cutting slot 60 and then deactuating the circuit 68 to stop the motor 65 and the feed rolls 45, 46 to stop the feed of the material M when the thinner portion P of the material M has reached the cutting slot 60. The adjustable pulse counter mechanism 69 is a commercially available device well understood by those with ordinary skill in the art.

The reason for the above described arrangement of the control means for the feed rolls 45, 46 is to insure that the thinner portion P of the material M has been centered as close as possible over the cutting slot 60. The adjustability of the pulse counter 69 allows adjustment for varying lengths of articles A in the material M. Also, this arrangement of a surface sensing switch 71 which signals the pulse counter 69 only after a first predetermined length of material M has been fed, insures that the surface sensing switch 71 will not sense pattern designs or other portions of the article A which may have been thinned out with respect to the normal thickness of the article A. Therefore, after a cutting operation, to be described below, the circuit 68 will be actuated for beginning the feed of the material M by the feed rolls 45, 46. The circuit will remain actuated for a first predetermined distance determined by adjustment of the pulse counter and which corresponds generally to the normal length of an article A minus the second predetermined distance between the switch 71 and the cutting slot 60. Thereafter, the switch 71 can influence the pulse counter 69 and actuation of the circuit 68 by signaling the pulse counter 69 when a thinned portion P passes thereunder so that the pulse counter 69 will deactuate the circuit 68 to stop the motor 65 and rotation of the feed rolls 45, 46 after the material M has been fed forwardly the second predetermined distance equal to the distance between the switch 71 and the cutting slot 60.

Figure 4:
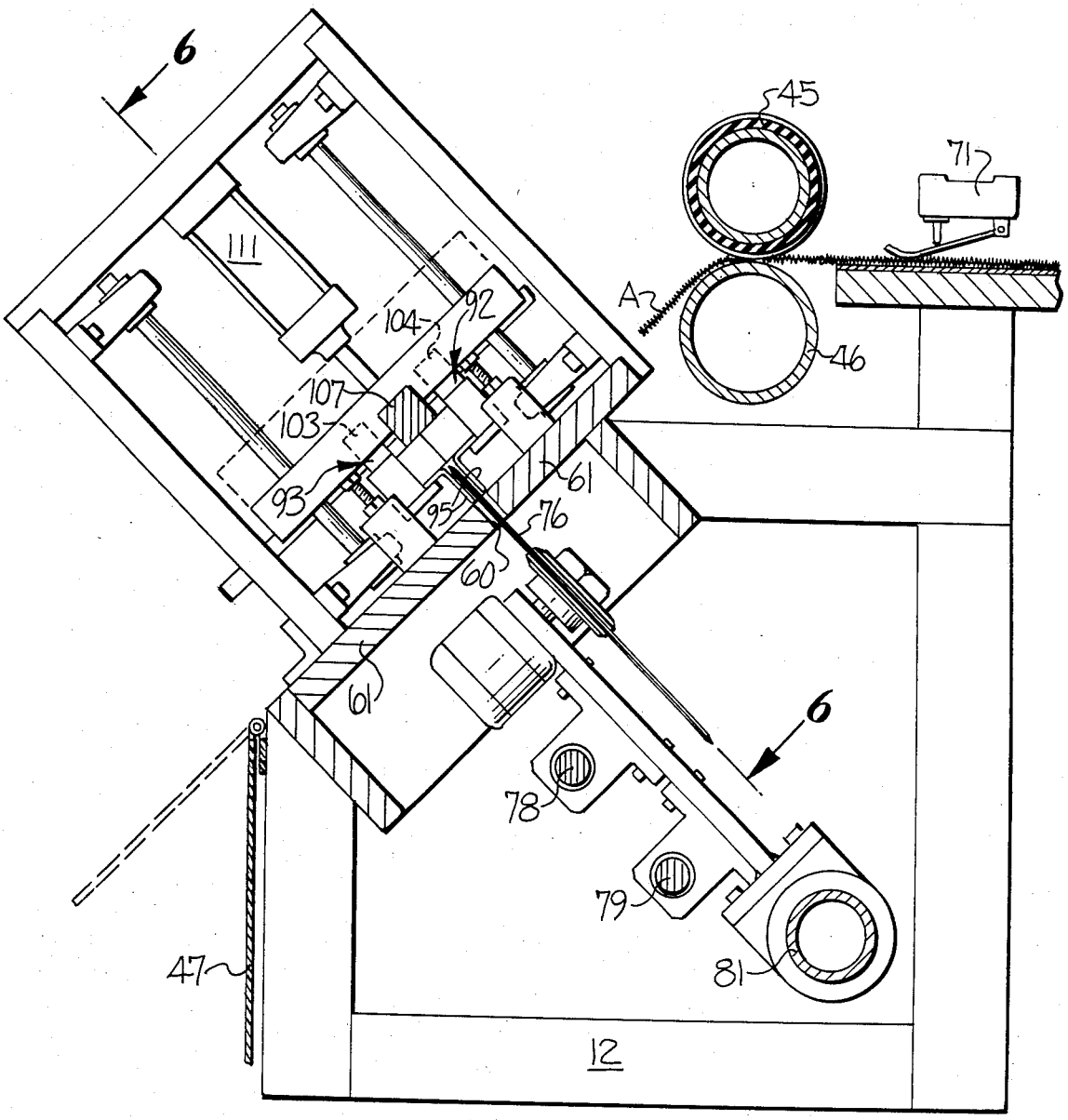
FIG. 4 is a sectional view, taken generally along the line 4—4 of FIG. 2, showing particularly the aligning and positioning mechanism and the cutting mechanism utilized in the apparatus of FIG. 1.
Figures 6, 7, 8:
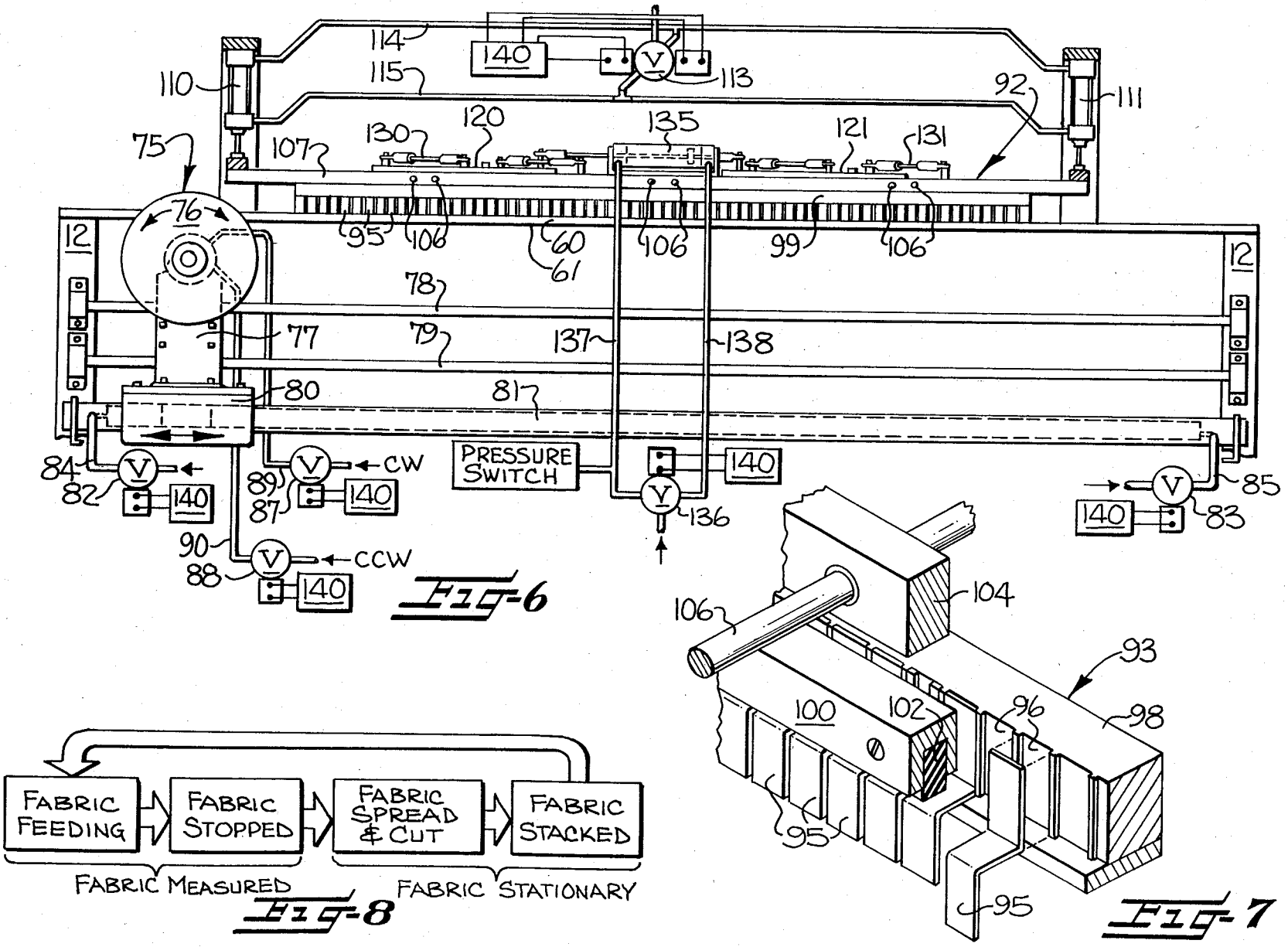
FIG. 6 is a sectional view, taken generally along the line 6—6 of FIG. 4, and illustrating therein diagrammatically some of the control and drive mechanisms for the aligning and positioning device and the cutting device.
FIG. 7 is an enlarged, perspective detail, showing some parts in section and being partially exploded, illustrating a preferred arrangement of one of the movable blade means of the cutting and positioning mechanism.
FIG. 8 is a diagrammatical chart illustrating operation of the various mechanisms and the apparatus of FIG. 1.

Referring now to the cutting means, generally indicated at 75 (see FIGS. 4 and 6), this cutting means 75 is carried by the frame 12 for transversely cutting the material M at the thinner separating portion P to separate the successive articles A. This cutting means 75 includes a rotating circular blade 76 rotatably mounted on a carriage means 77 mounted for movement transversely across the continuous material M for carrying the rotating cutting blade 76 through the cutting slot 60 in the stationary guide plate 61. The carriage means 77 is mounted on and guided by two stationary guide rods 78, 79 carried by the frame 12. Means are provided for alternately moving the carriage means in a first direction transversely across the material M for a cutting action by the rotating cutting blade 76 and then in the opposite direction transversely across the material M for another cutting action by the rotating cutting blade 76. Means are also provided for alternately rotating the cutting blade in one direction as the carriage means 77 moves in its first direction and then in the opposite direction as the carriage means 77 moves in its opposite direction.

The means for alternately moving the carriage means includes a double-acting fluid-operated piston and cylinder mechanism 80, 81 in which the piston 80 is secured to the carriage means 77 and the cylinder 81 extends transversely across the apparatus 12 and the material M. The piston and cylinder mechanism 80, 81 is controlled by suitable solenoid-operated valves 82, 83 positioned in fluid supply lines 84, 85 to opposite ends of the cylinder 81, so that fluid can be supplied respectively to opposite ends of the cylinder 81 upon actuation of the respective solenoid-operated valves 82, 83 for moving the carriage means 77 and the rotating cutter blade 76 in the back and forth movements transversely across the material M. Rotation of the circular cutting blade 76 is also accomplished by fluid-operated means in the form of solenoid-operated valves 87, 88 in fluid supply lines 89, 90 which respectively effect opposite rotations of the circular cutting blade 76. Actuation of these solenoid-operated valves 87, 88 is coordinated with actuation of solenoid-operated valves 82, 83 for the piston and cylinder mechanism 80, 81 of the carriage mechanism 77 so that rotation of the circular blade 76 is in the direction of movement of the carriage mechanism 77.

Means are also provided in the apparatus 12 of this invention for aligning and positioning the thinner separating portion P of the material M relative to the cutting mechanism 75 so that the cutting mechanism 75 will cut the articles A apart generally through the center of the thinner separating portion P of the material M. This aligning and positioning means is necessary since it is virtually impossible to accurately feed the thinner portion P of the material M into a position in which there are equal amounts on each side of the cutting blade 76 of the cutting mechanism 75 and on each side of the cutting slot 60. Additionally, due to the flexible nature of the textile material M, the thinner portions P are not always disposed exactly along a transverse axis through the material M, and one side or the other of the material M may be slightly askew with respect to the other side. This would result in uneven amounts of the thinner portion P being disposed on each side of the cutting blade 76 and the cutting slot 60.

Figure 5:
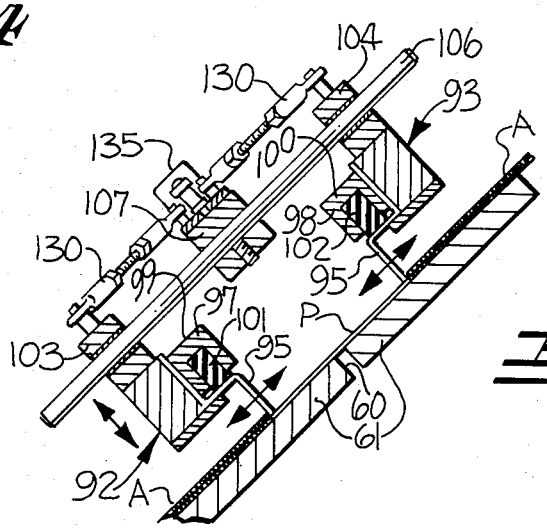
FIG. 5 is a sectional view, taken generally along the line 5—5 of FIG. 3.

The aligning and positioning means for the thinner separating portion P of the material M relative to the cutting mechanism 75 includes a pair of movable blade means 92, 93 (see FIGS. 2–7) positioned transversely across and perpendicularly to the upper surface of the material M and in equally spaced relationship on each side of the cutting blade 76 and cutting slot 60. As will be described in detail below (shown schematically in FIG. 5 by the arrows therein), the cutting blade means 92, 93 are mounted for movement between an upper position out of engagement with the upper surface of the material M when the material M is being fed by the feeding rolls 45, 46 and a lower position in engagement with the thinner separating portion P of the material M which has been positioned adjacent the cutting mechanism 75 and the cutting slot 60. The blade means 92, 93 are also mounted for movement, after engagement with the upper surface of the thinner portion P of the material M, between an inward position in which the blade means 92, 93 are spaced apart a distance less than the width of the thinner separating portion P and an outward position in which the blade means 92, 93 are spaced apart a distance equal to the width of the thinner separating portion P.

By movement between these inward and outward positions, the blade means 92, 93 will be moved apart into engagement with the respective edges of the thicker articles A joining each side of the thinner separating portion P transversely across the material M for aligning and positioning the thinner separating portion P equally on each side of the cutting slot 60 and the cutting mechanism 75 for a cutting operation by the cutting mechanism 75.

Preferably, each of the respective blade means 92, 93 (see particularly FIG. 7) comprises a plurality of individual blades 95 positioned end-to-end transversely across the material M and carried by individual slots or cut-outs 96 in mounting beams 97, 98 and are secured therein by respective members 99, 100 attached to the beams 97, 98 by screw members or the like. The members 99, 100 have cut-outs therein carrying resilient or rubber members 101, 102 which are in engagement with a surface of the individual blades 95 for allowing a slight upward movement of each individual blade 95 against the resilient members 101, 102. This arrangement allows an individual blade 95 to move upwardly upon contacting a thickened area in the thinner separating portion P of the material M, such as a hemmed side edge on the material M, while allowing the remaining blades 95 to be positioned in engagement with the upper surface of the thinner separating portion P of the material M regardless of the width of the material M.

For mounting of each of the blade means 92, 93 for the above described movements in the aligning and positioning operation, there is included first and second rails 103, 104 carrying the respective beams 97, 98 and mounted for inward and outward slidable movement toward and away from each other on guide rods 106. There is further included a third rail means 107 fixed in a stationary position on guide rods 106. The rail 107 carries the guide rods 106 and the rails 103, 104 for up and down movement with respect to the upper surface of the thinner separating portion P of the material M by being connected at opposite ends to piston and cylinder mechanisms 110, 111 which are mounted on and carried by the frame 12. These piston and cylinder mechanisms 110, 111 are operated by a solenoid-operated valve 113 in fluid supply lines 114, 115 connected to opposite sides of the piston and cylinder mechanisms 110, 111 so that the solenoid-operated valve 113 will control the above described up and down movement of the positioning and aligning means in accordance with actuation of the solenoid valve 113.

For effecting the above described inward and outward movement of the blade means 92, 93, there are provided spaced-apart plates 120, 121 slidably mounted on the top of the third rail 107 by slots 122, 123 therein and pins 124 extending upwardly from the rail 107 through the slots 122, 123. There is further provided adjustable-length rigid link members 130, 131 respectively connected between movable plates 120, 121 and movable rails 103, 104. There is further provided a fluid-operated piston and cylinder mechanism 135 connected between slidable plates 120, 121 for moving such plates 120, 121 toward and away from each other. The piston and cylinder mechanism 135 is controlled by a solenoid-operated valve 136 in fluid supply lines 137, 138 to opposite sides of the piston and cylinder mechanism 135.

Accordingly, if the piston and cylinder mechanism 135 is operated by the solenoid-operated valve 136 to expand, the slidable plates 120, 121 will be moved apart (from the position shown in FIG. 2 to the position shown in FIG. 3) to cause the rigid links 130, 131 to move the movable rails 103, 104 apart (from the position shown in FIG. 2 to the position shown in FIG. 3) for the outward movement of the blade means 92, 93 described above. Likewise, the solenoid-actuated valve can operate the piston and cylinder mechanism 135 to move the sliding plates 120, 121 and the movable rails 103, 104 to the inward position of the blade means 92, 93.

After the positioning and aligning blade means 92, 93 have been moved downwardly into position with the upper surface of the separating portion P against the guide plate 61 and have then been moved outwardly to position and align the thinner separating portion P equally on opposite sides of the cutting slots 60 and the cutting mechanism 75, the cutting mechanism 75 will be actuated to cut through generally the center of the separating portion P of the material M. The cut-apart article A will be held in its downwardly extending position on the guide plates 61, 47 by this clamping action of the positioning and aligning blade means 92 against the guide plate 61. As the aligning and positioning blade means 92 is retracted to its inward and upward position releasing the cut-apart article A, the movable guide plate 47 will be pivoted to a generally vertical position (see schematic illustrations in FIGS. 1 and 4) to allow the cut-apart article A to fall onto the stacking mechanism 16 in the form of a bar extending transversely across the apparatus 10. Such pivoting movement of the movable guide plate 47 is effected by a piston and cylinder mechanism 142 (see FIG. 9) which is connected at one end to the pivotally movable guide plate 47 and at the other end to the apparatus frame 13. This piston and cylinder mechanism 142 is controlled by a solenoid-operated valve 143 positioned in fluid supply lines 144, 145.

For purposes of coordinating all of the above described operations, a suitable commercially-available timing mechanism, generally indicated at 140, is connected to the control circuit 68 of the feeding rolls 45, 46, to the solenoid operated valves 113, 136 of the aligning and positioning blade means 92, 93, to the solenoid-actuated valves 82, 83, 87, 88 controlling operation of the cutting mechanism 75, and to the solenoid-operated valve 121 controlling operation of the pivotally mounted guide plate 47 to effect stacking of the cut articles A. This timing mechanism 140 can be programmed to effect the desired sequential operations of all of the above described mechanisms for the purposes described above. Such timing mechanisms are well understood by those with ordinary skill in the art and further description and illustration herein is not deemed necessary.

Accordingly, an apparatus 10 has been provided by this invention which will automatically cut apart successive articles A, such as terry towels, from a continuous length of material M, in which such articles A are separated therein by portions P extending transversely across the material M and of less thickness than the articles A, so that each cut article A has an equal amount of thinner portion P remaining on each cut edge for subsequent hemming or other finishing operation.

In the above described drawings and detailed description set forth above, there has been set forth a preferred embodiment of this invention and, although specific terms are employed, they are used in a generic and descriptive sense only and not for purposes of limitation.

What is claimed is:

1. Apparatus for automatically cutting apart successive articles, such as terry towels, from a continuous length of material, in which such articles are separated therein by portions extending transversely across the material and of less thickness than the articles, so that each cut article has an equal amount of the thinner portion remaining on each cut edge for subsequent hemming or the like; said apparatus comprising:

frame means;

cutting means carried by said frame means for transversely cutting the material to separate the successive articles;

means carried by said frame means for sequentially feeding the continuous material through said apparatus in generally a longitudinally-extending path of travel and for stopping the material in a cutting position in which the next successive thinner separating portion of the material is generally adjacent said cutting means; and means carried by said frame means for aligning and positioning the thinner separating portion of the material relative to said cutting means so that said cutting means will cut the articles apart generally through the center of the thinner separating portion of the material, said aligning and positioning means comprising a pair of movable blade means positioned transversely across and perpendicularly to one surface of the material in said apparatus and in equally spaced relation on each side of said cutting means, means for moving said pair of blade means between a first position out of engagement with the material when the material is being fed by said feeding means and a second position in engagement with the thinner separating portion of the material which has been positioned adjacent said cutting means, and means for moving each of said blade means after engagement with the material between an inward position in which said blade means are spaced apart a distance less than the longitudinal dimension of the thinner separating portion in the material and an outward position in which said blade means are spaced apart a distance substantially equal to the longitudinal dimension of the thinner separating portion, so that said blade means will be moved apart into engagement with the respective edges of the thicker articles joining the thinner separating portion transversely across the material for aligning and positioning the thinner separating portion equally on each side of said cutting means.

2. Apparatus, as set forth in claim 1, in which said aligning and positioning means further includes first and second movable rail means extending transversely across the material in said apparatus and individually carrying said respective blade means and third movable rail means mounted from said frame means and extending transversely across the material in said apparatus and carrying said first and second rail means for up and down movement therewith and for inward and outward movement with respect thereto.

3. Apparatus, as set forth in claim 2, in which said means for moving said pair of blade means between the first and second positions comprises fluid-operated piston and cylinder means connected between said frame means and said third rail means.

4. Apparatus, as set forth in claim 3, in which said means for moving each of said blade means between the inward and outward positions comprises spaced-apart plates slidably mounted on said third rail means, fluid-operated piston and cylinder means connected between said plates for moving said plates inward and outward along said third rail means, and rigid link members pivotally connected at respective ends thereof to said respective plates and to said respective first and second rail means so that said first and second rail means will be moved outward and inward as said plates are moved outward and inward.

5. Apparatus, as set forth in claim 1 or 4, in which each of said pair of blade means comprises a plurality of individual blades positioned end-to-end transversely across the material and means resiliently mounting each of said blades so that an individual blade can move upwardly upon contacting a thickened area in the thinner separating portion of the material, such as a hemmed side edge on the material, while allowing the remaining blades to be positioned in engagement with the upper surface of the thinner separating portion of the material regardless of the width of the material

6. Apparatus, as set forth in claim 1 or 4, in which said material feeding means includes driven feed roll means mounted on said frame means in advance of said cutting means and said aligning and positioning means in the path of travel of the material, guide plate means mounted on said frame means subsequent to said feed roll means in the path of travel of the material and positioned at a downwardly-extending angle to horizontal for receiving the material from said feed roll means and allowing the material to feed forwardly at the downwardly-extending angle by gravity into the cutting position, and control means operatively connected to said feed roll means for driving said feed roll means to feed the continuous material and for stopping the drive to stop the continuous material in the cutting position.

7. Apparatus, as set forth in claim 6, in which said control means includes selectively operable, electric motor means carried by said frame means and connected to said feed roll means for driving said feed roll means, electric circuit means connected to said motor means for selectively operating said motor means, adjustable counter means connected in said circuit means for actuating said circuit means to start said motor means to feed the material a first predetermined distance and for subsequently deactuating said circuit means to stop said motor means, material sensing switch means connected in said circuit means and carried by said frame means a second predetermined distance from said cutting means in the path of travel of the material and engaging the one surface of the continuous material for sensing the portions of less thickness in the material after the material has been fed the first predetermined distance and signaling said counter means for maintaining said circuit actuated for feeding the material the second predetermined distance and then deactuating said circuit to stop said motor means.

8. Apparatus, as set forth in claim 1 or 4, in which said apparatus further includes means carried by said frame means and positioned in advance of said cutting means in the path of travel of the material for aligning the traveling material in a desired longitudinal path of travel.

9. Apparatus, as set forth in claim 8, in which said material aligning means includes an aligning rod means pivotally mounted on said frame means for receiving the traveling material and for being moved about its pivot generally in the longitudinal direction of the traveling material to cause the traveling material to move transversely, means carried by said frame means and connected to said rod means for pivotally moving said rod means back and forth, and sensing and control means carried by said frame means and connected with said means for moving said rod means for sensing the longitudinal path of travel of the material and controlling movement of said guide rod means.

10. Apparatus, as set forth in claim 9, in which said means for moving said rod means comprises a fluid-operated double-acting piston and cylinder mechanism, and said sensing and control means comprises photoelectric cell means positioned for sensing one longitudinal edge of the traveling material and electrical circuit means connected between said piston and cylinder mechanism and said photoelectric cell sensing means for controlling operation of said piston and cylinder mechanism in response to the position of the edge of the traveling material as sensed by said photoelectric cell means.

11. Apparatus, as set forth in claim 1 or 4, in which said cutting means comprises a rotating circular cutting blade, carriage means carrying said rotating cutting blade for movement transversely across the continuous material, stationary guide means mounted on said frame means and movably carrying said carriage means for the transverse movement, means for alternately moving said carriage means in a first direction transversely across the material for a cutting action by said cutting blade and then in the opposite direction transversely across the material for another cutting action by said cutting blade, and means for alternately rotating said cutting blade in one direction as said carriage means moves in the first direction and then in the opposite direction as said carriage means moves in the opposite direction.

12. Apparatus, as set forth in claim 11, in which said means for alternately moving said carriage means comprises a double-acting, fluid-operated piston and cylinder means carried by said frame means, and in which said means for alternately rotating said cutting blade comprises fluid-operated means.

13. Apparatus, as set forth in claim 1 or 4, in which said apparatus further includes stacking means for receiving the cut article after cutting by said cutting means and for stacking the cut articles in a stack to be removed from said apparatus, said stacking means comprising guide plate means pivotally mounted on said frame means subsequent to said cutting means in the path of travel of the material for receiving the material prior to cutting means connected to said guide plate means for pivoting said guide plate between a first position at a downwardly-extending angle of less than 90 degrees to horizontal for receiving the material prior to cutting as the material is fed by said feeding means into cutting position and allowing the material to feed downwardly along said guide plate means by gravity and to a second position at generally 90 degrees to horizontal for allowing the article after cutting from the material to be released therefrom, and a stacking rod carried by said frame and positioned transversely across the material and beneath said guide plate means for receiving each cut article after pivotal movement by said guide plate means for forming a stack of cut articles.

* * * * *